United States Patent [19]

Mezger

[11] 4,221,309

[45] Sep. 9, 1980

[54] LADLE TILTING APPARATUS

[75] Inventor: Fritz Mezger, Muntelier, Switzerland

[73] Assignee: Maschinenfabrik & Eisengiesserei Ed. Mezger AG, Kallnach, Switzerland

[21] Appl. No.: 941,234

[22] Filed: Sep. 11, 1978

[30] Foreign Application Priority Data

Sep. 12, 1977 [CH] Switzerland ..... 11130/77

[51] Int. Cl.[2] ..... B22D 41/04

[52] U.S. Cl. ..... 222/604; 222/166

[58] Field of Search ..... 222/605, 604, 165, 166; 164/437–440

[56] References Cited

U.S. PATENT DOCUMENTS

| | | | |
|---|---|---|---|
| 896,054 | 8/1908 | Brugmann | 222/604 |
| 2,489,479 | 11/1949 | Cavallier | 222/604 X |

FOREIGN PATENT DOCUMENTS

| | | | |
|---|---|---|---|
| 867602 | 1/1953 | Fed. Rep. of Germany | 222/166 |
| 863644 | 4/1941 | France | 222/166 |

*Primary Examiner*—David A. Scherbel

*Attorney, Agent, or Firm*—Pearne, Gordon, Sessions

[57] ABSTRACT

In casting apparatus, a device is provided for the rapid exchange of a ladle to be tilted during the casting operation about a horizontal axis situated at its lip. In this device, a carriage can be run up and down on a stationary guide support which is curved about the aforementioned axis. The carriage has supporting arms which cooperate with hooking members disposed at the rear of the ladle in order to hold the ladle fast during tilting. After the empty ladle has been replaced on a dolly upon which it was moved into position, the supporting arms make it possible to move this ladle immediately away to the side and simultaneously to move a full ladle into a position where it is ready for lifting and tilting.

3 Claims, 3 Drawing Figures

LADLE TILTING APPARATUS

Figure 1:
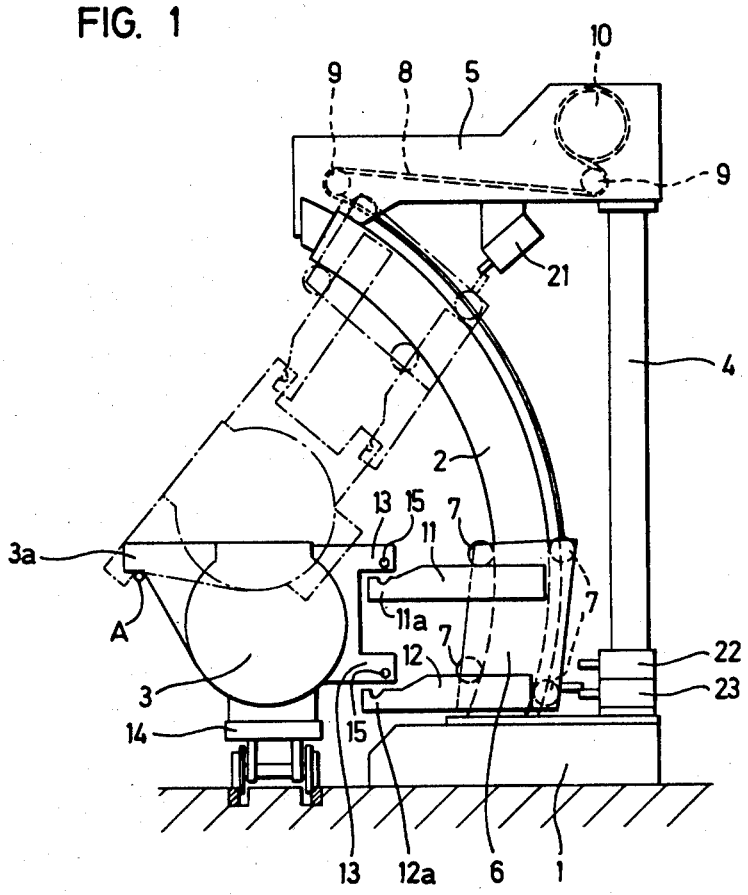

This invention relates to casting apparatus of the type having a ladle tiltable during the casting operation about a fixed geometrical axis situated at the lip of the ladle.

There are two different ways of refilling an empty ladle in casting apparatus: either the molten metal is brought to the casting location in a transfer ladle and is poured from the latter into the empty ladle of the casting apparatus, or the ladle is exchanged, i.e., the empty ladle is replaced by a full one.

The present invention has to do only with the second of these types of apparatus, i.e., with apparatus in which the ladle is exchanged.

Using conventional methods, this exchange of ladles always takes quite some time. During this time, no casting can be done. In most cases, this means a loss of production of the mold installation, the mold turntable, or whatever is being used for casting; a rather long standstill is necessary in cadenced installations, and in continuously driven installations the speed of travel must often be reduced for this reason. The casting apparatus is usually designed so that the ladle is tilted about its lip. The ladle is then either supported directly at its lip or held by a support device having the tilting point and the corresponding bearing arrangement at the level of the lip. In both cases, the ladle is exchanged in that it can be either lifted out vertically by means of a hoist or moved away to the rear by means of a suitable drive. It may, for example, be moved away by providing the casting apparatus with a dolly having driven rollers, the ladle to be exchanged being set down upon this dolly. Behind the casting apparatus are two driven roller-track sections, one of which directly adjoins the roller-track section of the casting apparatus. The ladle which has become empty can thereby be moved out of the casting apparatus. On the second roller-track section, there is already a dolly upon which the full ladle has previously been placed. Now either the casting apparatus traverses to the second roller-track section, whereupon the dolly with the full ladle is moved in, or the two roller-track sections are mounted on a truck by means of which they are alternately brought to the casting apparatus. In both methods, the empty ladle must first be removed, and only then, in a second operation, can the full ladle be inserted. Hence the time required is substantial, somewhat along the following lines:

| | |
|---|---|
| 1. Move in hoist and attach empty ladle: | 8 sec. |
| 2. Lift empty ladle out and move it away: | 10 sec. |
| 3. Move full ladle in and set it down with the hoist, precisely centered: | 14 sec. |
| Total time: | 32 sec. |
| The time using the second method is as follows: | |
| 1. Move empty ladle back onto roller track: | 6 sec. |
| 2. Move roller track away to the side: | 4 sec. |
| 3. Move in full ladle: | 8 sec. |
| Total time: | 18 sec. |

Now if the admissible exchange time may amount, for example, to only 7 seconds without the mold installation suffering a production loss, since the floor-mounted conveyor is advancing during that time and hence casting could not take place in any event, then according to the second method a waiting-time of $18-7=11$ seconds would result for the installation. In the case of a ladle exchange at a cadence of every three minutes, for instance, totalling 160 exchanges in 8 hours of working time, this means $160\times 11$ seconds of lost time, or a production loss of more than 6%.

It is an object of this invention to provide improved casting apparatus of the type initially mentioned designed so that the ladle can be exchanged without loss of production of the mold installation to the extent possible, or in other words, so that an exchange time of, insofar as possible, not more than 7 seconds can be achieved.

To this end, in the casting apparatus according to the present invention, the improvement comprises a ladle quickchange device in which a carriage can be motor-driven up and down on a stationary guide support curved about the aforementioned axis, the carriage having at least one supporting arm, the free end portion of the supporting arm being made hook-shaped in such a way that at the beginning of the upward travel of the carriage from a starting position, this end portion engages hooking members formed at the rear of a ladle resting in a position of readiness on a dolly, then holds the ladle fast during the further upward travel of the carriage which takes place for carrying out the casting operation by tilting of the ladle, and thereafter releases the ladle by means of a brief, further downward movement of the carriage into its starting position after the empty ladle has been replaced on the dolly which has remained in place, in order then to enable the ladle to be moved away to the side without hindrance on the dolly carrying it and to enable a full ladle resting on another dolly to be moved up simultaneously into the aforementioned position of readiness.

Figure 2:
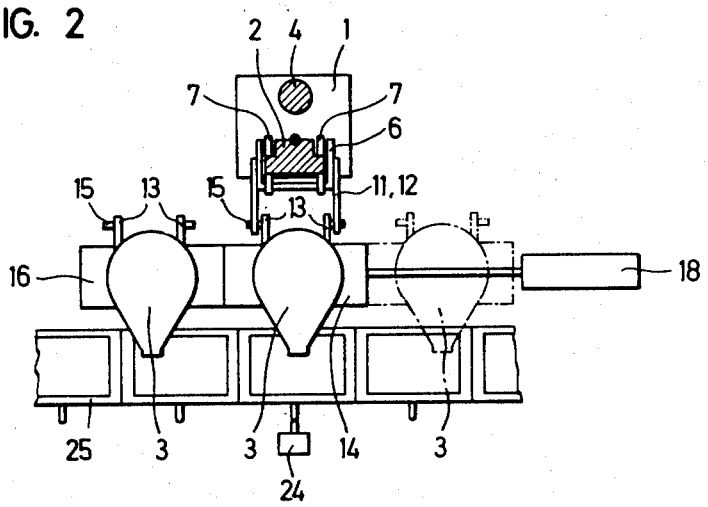
Figure 3:
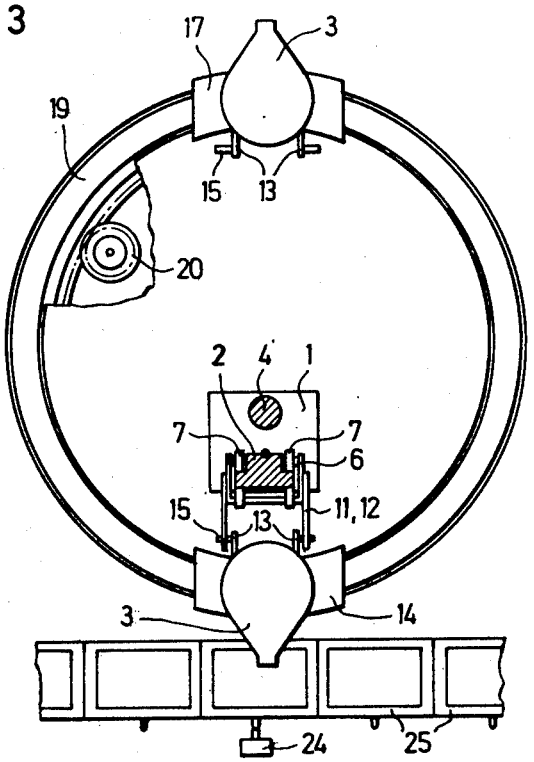

Preferred embodiments of the invention will now be described in detail with reference to the accompanying drawings, in which:

FIG. 1 is an elevation of the main part of the casting apparatus in a preferred embodiment of the invention, FIG. 2 is a top plan view of a first embodiment in which the main part according to FIG. 1 is shown in horizontal section, a row of dollies, each bearing a box mold or a permanent mold also being illustrated, and FIG. 3 is a top plan view of a second embodiment in which the main part according to FIG. 1 is likewise shown in horizontal section, a row of dollies carrying box molds or permanent molds also being shown here.

The main part of the casting apparatus shown in FIG. 1 comprises a ladle quick-change device. Firmly set up on a base 1 is a guide support 2 which is curved about a fixed geometrical axis A about which a casting ladle 3 containing molten metal is to be tilted during the casting operation; the axis A is situated at the lip 3*a* of the ladle 3. Also anchored in the base 1 is a column 4 which is rigidly connected at the top to the guide support 2 by a hollow bracket 5. A carriage 6 is guided for travel up and down the guide support 2 by means of rollers 7 mounted on the carriage 6 (cf. also FIGS. 2 and 3) and is also connected by a cable 8, which slides in a guide groove of the guide support 2 and is guided over rollers 9 mounted in the bracket 5, to a motor-driven cable winch 10. As a result, the carriage 6 can travel up and down by means of a motor drive. Secured to each side of the carriage 6 are supporting arms, viz., upper supporting arms 11 and lower supporting arms 12. The free end portions 11*a* and 12*a*, respectively, of the arms 11, 12 are given a hook-shape so that at the beginning of upward travel of the carriage 6 from a starting position, these end portions engage hooking members 13 formed at the rear of a ladle 3 resting in a position of readiness on a dolly 14. For this purpose, the hooking members 13 comprise laterally projecting pins 15. It will be obvious that the design is such that when the carriage 6 continues to move upward for carrying out the casting operation by tilting of the ladle 3, the supporting arms 11, 12 continue to hold the ladle 3 fast, and that the ladle 3 is released by a brief further downward movement of the carriage 6 into its starting position after the ladle 3 has again been set down on the dolly 14, which has remained in place, in order to enable this ladle to be moved away laterally on the dolly 14 carrying it and to enable a full ladle 3 resting on another dolly (designated by reference numeral 16 in FIG. 2 and by reference numeral 17 in FIG. 3) to be moved up simultaneously into the mentioned position of readiness.

In the embodiment of FIG. 2, the two dollies 14 and 16 are coupled directly next to one another and can be motor-driven back and forth, by means of a piston-cylinder unit 18, on a path parallel to the ladle-tilt axis A.

In the embodiment of FIG. 3, the two dollies 14 and 17 can be motor-driven on a circular, closed-circuit path on which they are disposed diametrically opposite one another and within which the guide support 2 is disposed. It may be provided, for example, that the dollies 14 and 17 are secured to a rotating track 19 embedded in the floor, the track 19 being drivable by a motor (not shown) via a pinion 20.

It will be immediately apparent that the controls of the drives of the casting apparatus described, i.e., the motor of the winch 10, on the one hand, and the unit 18 or the drive for the rotating track 19, on the other hand, may easily be incorporated in a follow-up control device which may also include the drive for indexing the dollies 25 carrying the box molds or permanent molds, as well as special arrangements for controlled tilting of the ladle 3 during the individual casting operations. Shown in the drawings are various sensing switches which can be used in such a follow-up control, among others an upper sensing switch 21 which senses the arrival of the carriage 6 in an upper end position so that the lowering of the carriage 6 can thereupon be initiated; a lower sensing switch 22 which senses when the supporting arms 11, 12 disengage from the hooking members 13 after the ladle 3 has been set down on the dolly 14, 16, or 17 so that the lowering of the carriage 6 can thereupon be braked; a further lower sensing switch 23 which senses that the carriage 6 has reached its lowermost position so that the lateral removal of the dolly 14 can thereupon be initiated and at the same time the dolly 16 or 17 with the full ladle 3 then be moved in; and a sensing switch 24 which senses that a box mold or permanent mold is in the position of readiness for casting from the ladle 3. It will be readily apparent that especially when such a control is provided, the exchange of the empty ladle 3 for a full one can be carried out very quickly with the casting apparatus according to the present invention.

What is claimed is:

1. In casting apparatus of the type having a plurality of ladles each having a lip and being tiltable during casting about a fixed geometrical axis situated at said lip, and at least two dollies for transporting said ladles, the improvement which comprises the provision of a ladle quick-change device including:

hooking members disposed on each of said ladles at a location thereof remote from said lip, a stationary guide support curving about said geometrical axis, and a carriage designed for motor-driven travel up and down said guide support and having at least one supporting arm including a hook-shaped end portion adapted to cooperate with said hooking members for holding said ladles fast during said travel of said carriage and during casting and for releasing said ladles when said carriage reaches the lowermost position of said travel, one of said dollies always being so disposed with respect to said carriage as to present one of said ladles filled with molten metal thereto, to receive said one of said ladles in emptied condition after said travel up and down of said carriage, and to be moved laterally away from said guide support in order to make way for the simultaneous presentation of another of said ladles filled with molten metal transported on another one of said dollies.

2. The casting apparatus of claim 1, wherein said at least two dollies are directly adjacent and coupled to one another for motor-driven travel along a path parallel to said geometrical axis.

3. The casting apparatus of claim 1, wherein said at least two dollies are disposed diametrically opposite one another for motor-driven travel along a circular path around said guide support.

* * * * *